US009004103B2

(12) United States Patent
Foo et al.

(10) Patent No.: US 9,004,103 B2
(45) Date of Patent: Apr. 14, 2015

(54) APPARATUS AND METHOD FOR OFFLOADING A HYDROCARBON FLUID

(75) Inventors: Kok Seng Foo, Singapore (SG); Alex Kah Keong Tan, Singapore (SG)

(73) Assignee: Keppel Offshore & Marine Technology Centre Pte Ltd, Singapore (SG)

( * ) Notice: Subject to any disclaimer, the term of this patent is extended or adjusted under 35 U.S.C. 154(b) by 474 days.

(21) Appl. No.: 13/407,577

(22) Filed: Feb. 28, 2012

(65) Prior Publication Data

US 2012/0152366 A1 Jun. 21, 2012

Related U.S. Application Data

(63) Continuation-in-part of application No. 13/236,262, filed on Sep. 19, 2011.

(60) Provisional application No. 61/451,710, filed on Mar. 11, 2011, provisional application No. 61/385,459, filed on Sep. 22, 2010.

(51) Int. Cl.

| | |
|---|---|
| ***B67D 7/04*** | (2010.01) |
| ***B67D 9/00*** | (2010.01) |
| ***B63B 27/34*** | (2006.01) |
| *B63B 27/24* | (2006.01) |

(52) U.S. Cl.

CPC . *B67D 9/00* (2013.01); *B63B 27/24* (2013.01); *B63B 27/34* (2013.01)

(58) Field of Classification Search

CPC ..... B67D 9/02; B67D 9/00; B63B 27/24; B63B 27/34; B63B 27/10; B63B 27/36

USPC ..... 137/615; 212/307–311; 294/81.1, 81.4; 141/382, 387

See application file for complete search history.

(56) References Cited

U.S. PATENT DOCUMENTS

| | | | | | |
|---|---|---|---|---|---|
| 2,818,891 | A | * | 1/1958 | Loeser | 141/388 |
| 2,914,080 | A | * | 11/1959 | Silveston | 137/236.1 |
| 2,922,446 | A | * | 1/1960 | Sheiry | 141/388 |
| 3,032,082 | A | * | 5/1962 | Vilain | 141/388 |
| 3,210,114 | A | * | 10/1965 | Lawton | 294/81.4 |

(Continued)

OTHER PUBLICATIONS

Hoog, S., Koch, H., Huhn, R., Frohne, C., Homann, J., Clauss, G., . . . Testa, D. (2009). LNG transfer in harsh environments—introduction of a new concept. *OTC-19866-PP, Offshore Technology Conference*. Houston, Texas.

(Continued)

*Primary Examiner* — John Rivell
*Assistant Examiner* — David Colon Morales
(74) *Attorney, Agent, or Firm* — John P. White; Cooper & Dunham LLP

(57) ABSTRACT

Disclosed are various apparatus and method for transferring a hydrocarbon fluid between two bodies. An offloading system for facilitating hydrocarbon fluid transfer between two bodies includes a transfer skid and a lifting system. The transfer skid is movable from a first body to a second body to be installed thereupon to facilitate hydrocarbon fluid transfer to and from the first and the second bodies. The lifting system may be provided on the first body, and includes an extendable lifting arm; a spreader frame attachment which includes at least a first and a second lifting device to support the transfer skid, wherein the spreader frame attachment is rotatably coupled to the extendable lifting arm to allow angular or rotatable adjustment of the transfer skid in a horizontal plane.

15 Claims, 19 Drawing Sheets

(56) References Cited

U.S. PATENT DOCUMENTS

| | | | | | |
|---|---|---|---|---|---|
| 3,217,748 | A | * | 11/1965 | Harper | 137/615 |
| 3,228,421 | A | * | 1/1966 | Sheiry | 137/615 |
| 3,249,121 | A | * | 5/1966 | Bily | 137/615 |
| 3,401,804 | A | * | 9/1968 | Link | 212/273 |
| 3,567,040 | A | * | 3/1971 | Thomson | 212/242 |
| 3,608,577 | A | * | 9/1971 | Blanchard | 137/355.17 |
| 3,974,864 | A | * | 8/1976 | Fournier et al. | 141/100 |
| 4,019,333 | A | * | 4/1977 | Karsan | 405/170 |
| 4,168,857 | A | * | 9/1979 | Kloos | 294/81.4 |
| 4,220,177 | A | * | 9/1980 | Gill | 137/615 |
| 4,286,722 | A | * | 9/1981 | Tax et al. | 212/242 |
| 4,350,254 | A | * | 9/1982 | Noly | 212/279 |
| 4,352,516 | A | * | 10/1982 | Gasper | 294/81.1 |
| 4,388,948 | A | * | 6/1983 | Carminati et al. | 137/615 |
| 4,538,849 | A | * | 9/1985 | Khachaturian et al. | 294/81.1 |
| 5,067,013 | A | * | 11/1991 | Lindholm et al. | 348/94 |
| 5,163,726 | A | * | 11/1992 | Boos et al. | 294/81.1 |
| 6,609,544 | B1 | * | 8/2003 | Williamson | 141/387 |
| 6,637,479 | B1 | * | 10/2003 | Eide et al. | 141/387 |
| 7,066,219 | B2 | * | 6/2006 | Poldervaart et al. | 141/387 |
| 7,147,022 | B2 | * | 12/2006 | Le Devehat | 141/387 |
| 7,174,930 | B2 | * | 2/2007 | Poldervaart et al. | 141/387 |
| 7,565,982 | B2 | * | 7/2009 | Kurotsu et al. | 212/298 |
| 2004/0011424 | A1 | * | 1/2004 | Dupont et al. | 141/279 |
| 2007/0289517 | A1 | * | 12/2007 | Poldervaart et al. | 114/230.15 |
| 2009/0165874 | A1 | | 7/2009 | Pollack et al. | |
| 2009/0272459 | A1 | * | 11/2009 | Biaggi | 141/1 |
| 2010/0147398 | A1 | | 6/2010 | Thomas et al. | |
| 2012/0230772 | A1 | * | 9/2012 | Foo et al. | 405/211 |

OTHER PUBLICATIONS

European Search Report, including Annex to the European Search Report and European Search Opinion, dated Dec. 27, 2011 and issued in connection with European Patent Application No. EP 11 18 2036. 1.

* cited by examiner

APPARATUS AND METHOD FOR OFFLOADING A HYDROCARBON FLUID

CROSS-REFERENCE TO RELATED APPLICATIONS

This application is a continuation-in-part of U.S. Ser. No. 13/236,262, filed Sep. 19, 2011, and claims the benefit of U.S. Provisional Application No. 61/451,710, filed Mar. 11, 2011 and U.S. Provisional Application No. 61/385,459, filed Sep. 22, 2010, the entire contents of each of which are hereby incorporated by reference into this application.

BACKGROUND

1. Technical Field

Embodiments of the invention relate generally to apparatus and method for transferring a hydrocarbon fluid, e.g. liquefied natural gas (LNG), between two bodies, e.g. a carrier vessel, a floating/fixed hydrocarbon facility.

2. Description of Related Art

Various apparatus and methods for offloading hydrocarbon fluid from a carrier vessel to a floating/fixed hydrocarbon facility, and vice versa, are available but have inherent problems. Offloading hydrocarbon fluid between vessels is also problematic due to unpredictable changes to sea state conditions.

US 2009/0165874 A1 (Pollack et al.) discloses a hydrocarbon transfer system that includes a first structure with a length direction and a transverse direction having a frame carrying a vertical arm with at its end a fluid connecting member for connecting to a second structure which is moored alongside the first structure. The connecting member includes a winch and first guiding elements for engaging with second guiding elements on the second structure by connecting a wire to the winch on one end to the second structure on the other end, and a tension device for moving the vertical arm away from the second structure for tensioning the wire. Due to the inherent rigidity in the above-described members, the system is susceptible to damage if there is a large relative movement between the first and second structures and/or relative dynamic motions are frequent due to severe weather condition. Further, the use of swivels increases a likelihood of leakage during hydrocarbon transfer. This system is also very expensive to manufacture.

US 2010/0147398 A1 (Thomas at al.) discloses a platform and a manifold, the latter being intended to be connected to a fluid tank. The manifold comprises a length of rigid tube defining a pipe of approximately horizontal axis and a length of connecting tube for connection to a transfer line connected to the length of rigid tube. The length of connecting tube is permanently attached to the length of rigid tube and is hinged to the length of rigid tube to allow movement relative to the length of rigid tube between: —a retracted rest position in which the length of connecting tube extends entirely inside the inner edge; and—a first or filling position, in which the free end of the length of connecting tube projects out from the outer edge of the support platform.

In S. Hoog, H. Koch, R. Huhn, C. Frohne, J. Homann, G. Clauss, F. Sprenger, D. Testa: "LNG Transfer in Harsh Environments-Introduction of a New Concept", OTC 19866, Offshore Technology Conference, Houston, USA, 2009, an approach and handling system is disclosed for use when a carrier vessel and terminal are moored in a tandem configuration. A loading bridge is provided at the terminal to handle four transfer pipes simultaneously by a two part header structure which is transferred between the terminal and carrier vessel. The two part header structure combines the following active functionality: simultaneous support and operation of all four flexible pipes with related Quick Connect/Disconnect Couplers (QCDC) and Emergency Release Couplings (ERC); winch driven fine approach, alignment and landing at the LNGC receiving manifold aided; damping of the touch down at the manifold by means of hydraulic dampeners; operation (closing and disconnection) of all four QCDCs; operation (closing and disconnection) of all four ERCs in an Emergency Shut-Down (ESD) situation; remote controlled departing of both header parts (and subsequent lifting of the upper means of pre-tensioned wires suspended from the loading bridge) in an ESD situation. Normally, the carrier vessel would need to move away from the terminal and hence, in this system, before the carrier vessel can move away to safety, the header structure has to be lifted clear to prevent collision with parts of the carrier vessel.

SUMMARY

Embodiments of the invention disclose various apparatus and method for transferring a hydrocarbon fluid between two bodies which may be floating and/or fixed.

According to one embodiment, an offloading system for facilitating hydrocarbon fluid transfer between two bodies includes a transfer skid and a lifting system for manipulating the transfer skid. The transfer skid is movable from a first body to a second body to be installed thereupon to facilitate hydrocarbon fluid transfer to and from the first and the second bodies. The transfer skid may comprise a skid frame, several pipes which are rigidly attached to the skid frame, and jack screw mechanisms for independently adjusting the pipes relative to the skid frame. Each of the pipes has a first end and a second distal end, where a coupler is provided at the first end to connect to the second body after installing the transfer skid on a second body, and an emergency release coupling is provided at the second end of the each of the pipes. A transfer hose is interposed or connected between the emergency release coupling and the first body.

The lifting system may be provided on the first body, and includes an extendable lifting arm; a spreader frame attachment which includes at least a first and a second lifting device to support the transfer skid, wherein the spreader frame attachment is rotatably coupled to the extendable lifting arm to allow angular adjustment of the transfer skid in a horizontal plane.

In the spreader frame attachment, the first lifting device is adapted to support one side of the skid frame which is proximate to the coupler, and the second lifting device is adapted to support an opposed side of the skid frame which is proximate to the emergency release coupling. The first and the second lifting devices are adapted to independently adjust the skid frame to prevent tilting of the skid frame.

Each coupler of the transfer skid is adapted to connect to a pipe extension installed on the second body, wherein the pipe extension includes a flexible expansion joint which is deflectable in an axial direction, a lateral direction and an angular direction to align with the coupler.

Upon installing the transfer skid onto the second body, the coupler is disposed inboard the second body while the emergency release coupling is disposed outboard of the second body, since the coupler and the emergency release coupling are arranged spaced apart by the pipes connected therebetween.

During an emergency release operation, the emergency release coupling disconnects the transfer hose from the transfer skid installed at the second body by way of detaching a part of the emergency release coupling. The detached part of the emergency release coupling, together with the corresponding transfer hose attached thereto, is allowed to fall away from the transfer skid due to gravity force. As the detached part of the emergency release coupling is supported by the lifting system, which is provided on the first body, to limit the fall of the detached part of the emergency release coupling, the detached part of the emergency release coupling and its corresponding transfer hose are prevented from falling into the water, and are lifted and returned to the first body.

Other features and advantages of the invention will be apparent from the following description and accompanying drawings.

BRIEF DESCRIPTION OF THE DRAWINGS

Embodiments of the invention are disclosed hereinafter with reference to the drawings, in which.

DETAILED DESCRIPTION

Figure 1:
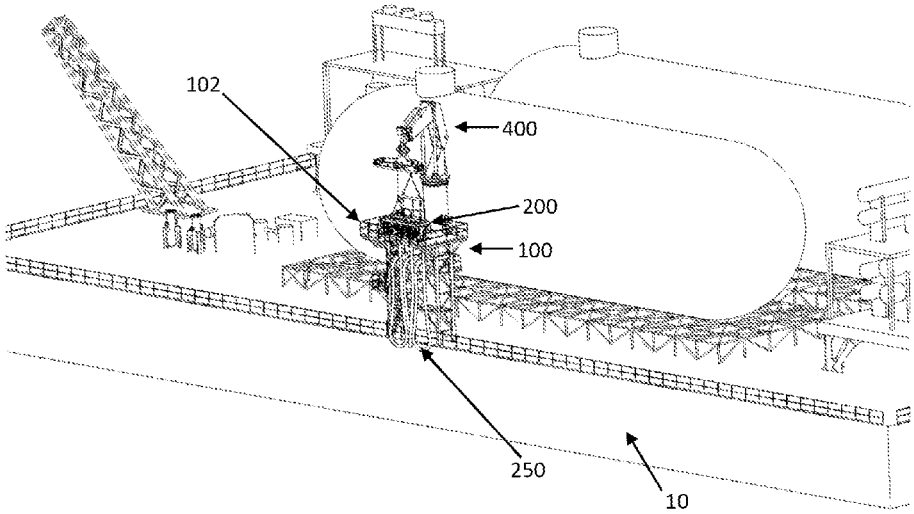
FIG. 1 illustrates an offloading system according to one embodiment of the invention.

In the following description, numerous specific details are set forth in order to provide a thorough understanding of various illustrative embodiments of the invention. It will be understood, however, to one skilled in the art, that embodiments of the invention may be practiced without some or all of these specific details. In other instances, well known process operations have not been described in detail in order not to unnecessarily obscure pertinent aspects of embodiments being described. In the drawings, like reference numerals refer to same or similar functionalities or features throughout the several views.

Embodiments of the invention provide an apparatus and method for offloading or transferring a hydrocarbon fluid between two bodies in ship-to-ship, ship-to-shore, and shore-to-ship applications. Examples of the two bodies involved include, but are not limited to, a carrier vessel, a barge, a receiving terminal, a floating/fixed hydrocarbon facility, offshore platforms. Hydrocarbon fluid to be transferred includes, but is not limited to, liquefied natural gas (LNG) and liquefied petroleum gas (LPG).

FIG. 1 illustrates an offloading system according to one embodiment of the invention. Particularly, FIG. 1 shows a utility platform 100, a transfer skid 200, a lifting system 400 for manipulating the transfer skid 200, transfer or flexible hoses 250 which connect pipes 204 of the transfer skid 200 to manifolds on the floating/fixed hydrocarbon facility 10 (also referred to as "first body").

The utility platform 100 may be provided as an elevated structure which houses various utilities for handling the transfer skid 200 and transfer hoses 250. A parking platform 102 may be provided on the utility platform 100 to support or house the transfer skid 200 in a parking position. The parking platform 102 may be arranged at a suitably elevated level above a main deck of the floating/fixed hydrocarbon facility 10 so that when the transfer skid 200 is arranged in a parking position, the transfer hoses 250 connected to the transfer skid 200 may be allowed to hang in a catenary form (i.e. naturally free-hanging).

Figure 2A:
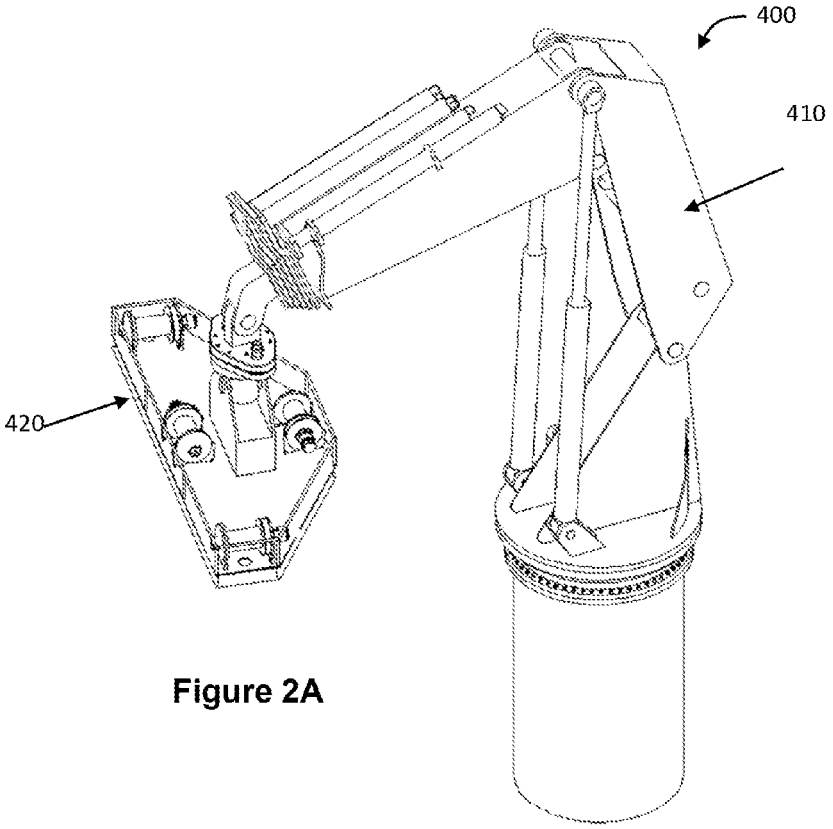
FIG. 2A illustrates a lifting system according to one embodiment of the invention.
Figure 2B:
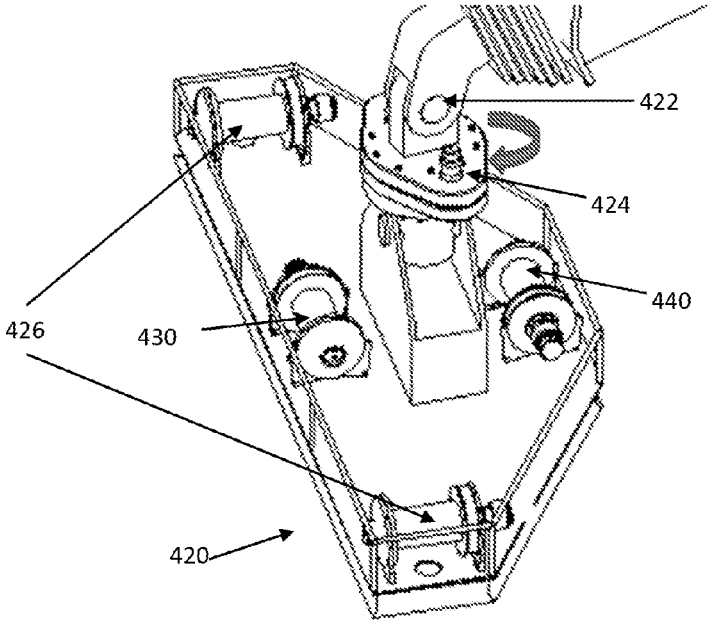
FIG. 2B is a close-up view of a spreader frame of the lifting system of FIG. 2A.
Figure 3A:
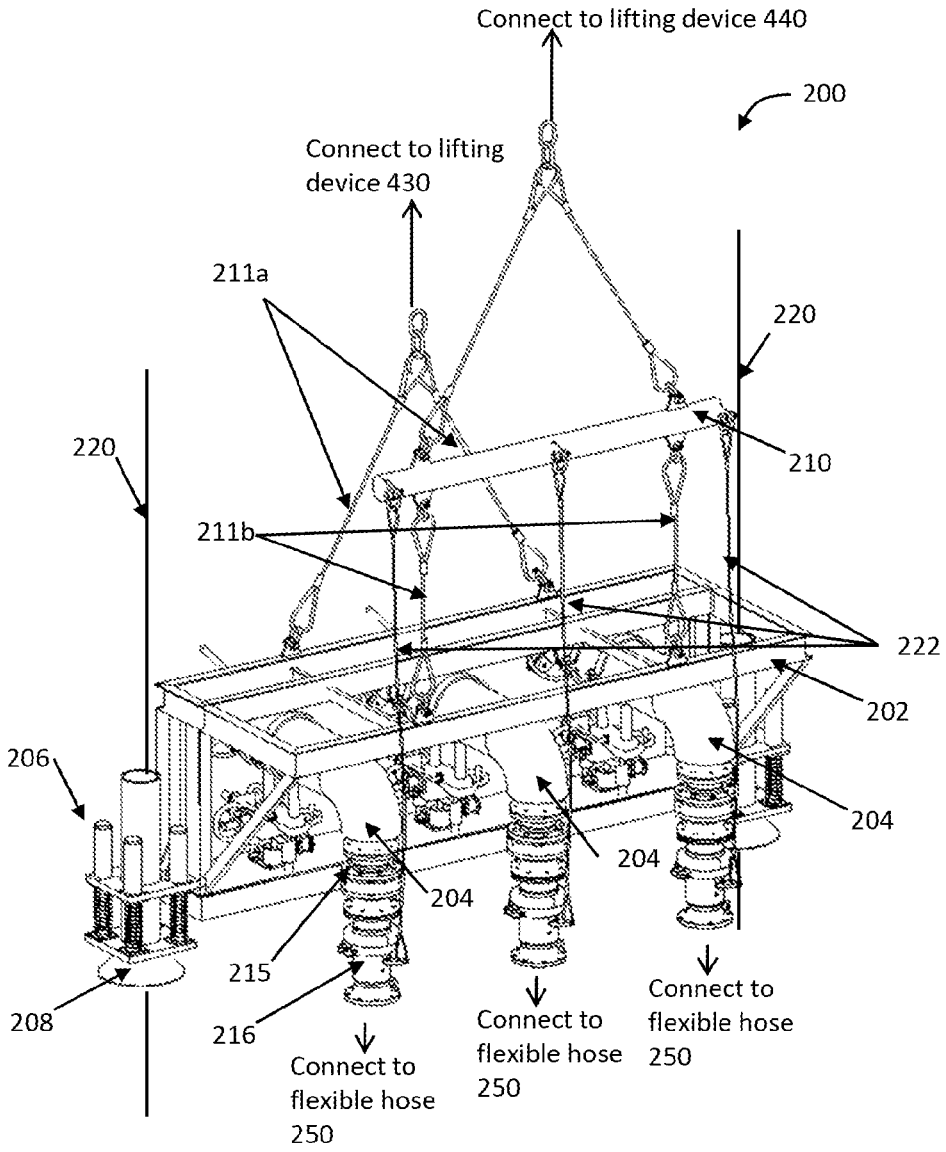
FIG. 3A is a rear view of a transfer skid.
Figure 3B:
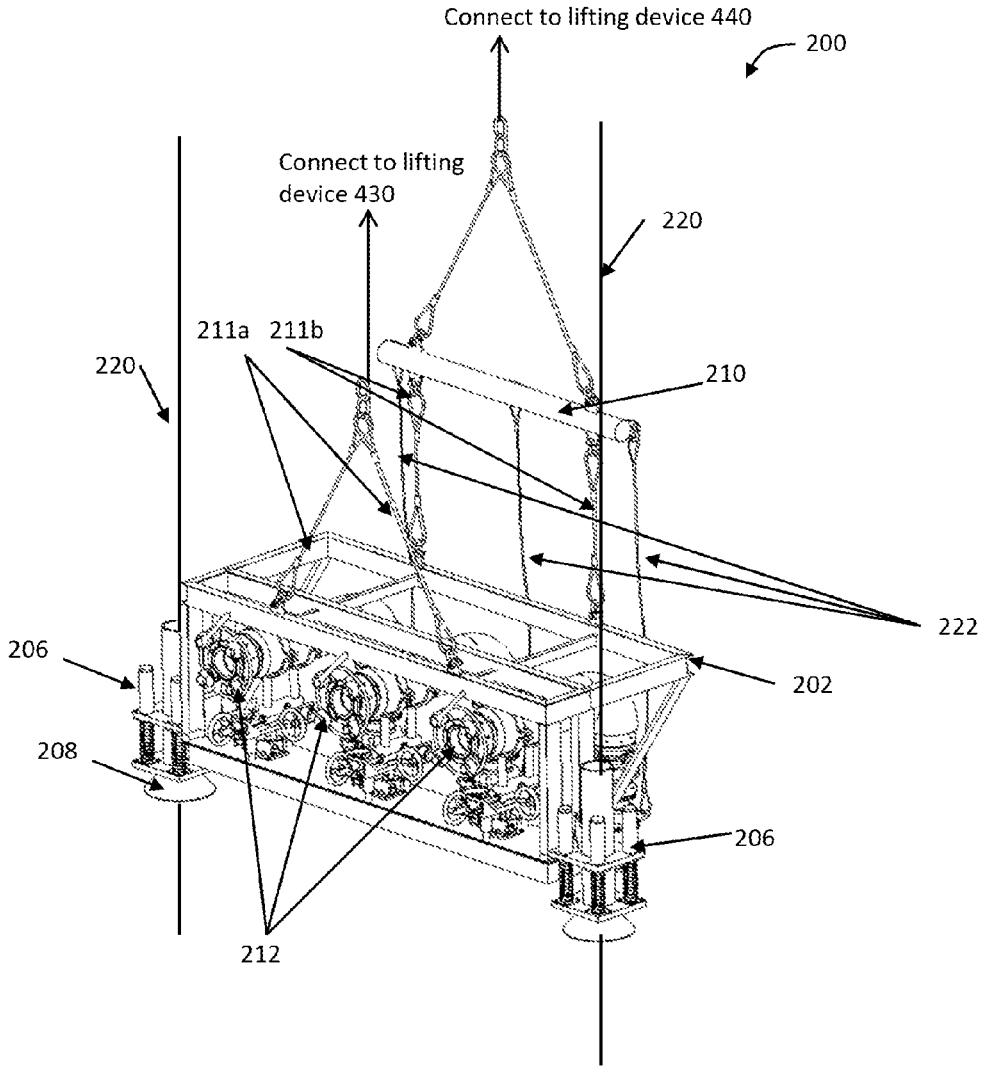
FIG. 3B is a front view of the transfer skid of FIG. 3A.
Figure 3C:
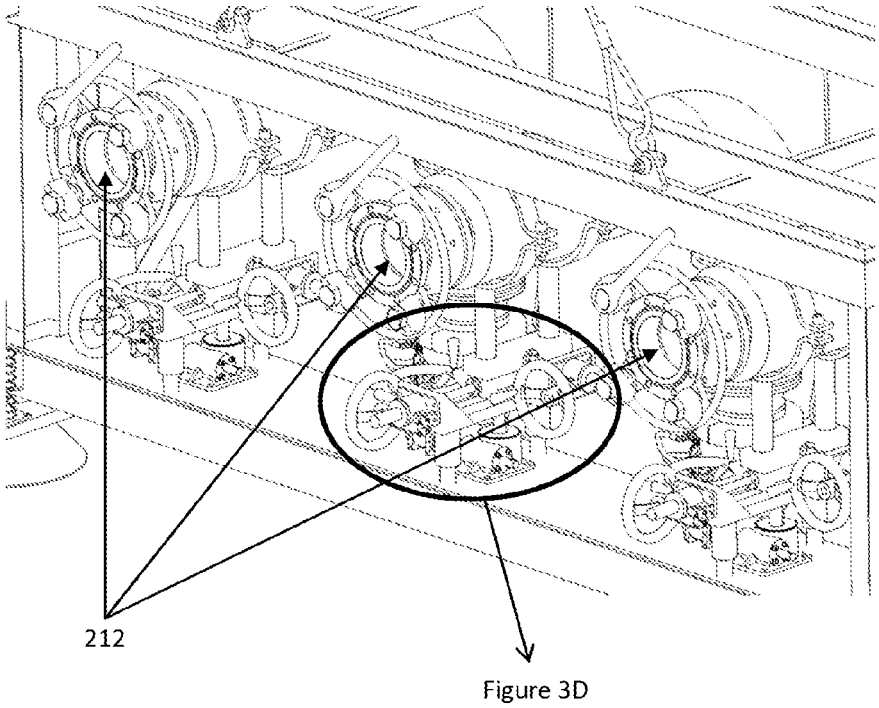
FIG. 3C is a close-up view of the transfer skid of FIG. 3B.
Figure 3D:
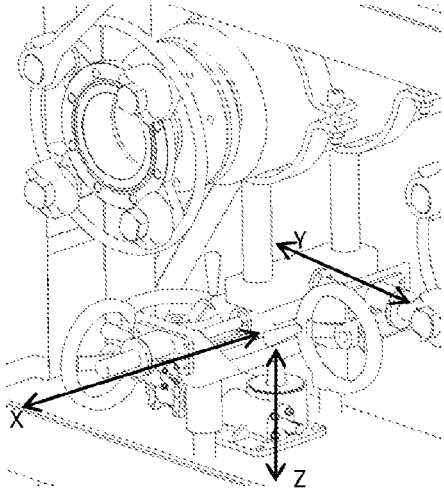
FIG. 3D is a close-up view of a jack screw mechanism of FIG. 3C.

FIGS. 2A and 2B illustrate a lifting system 400 which may be provided to manipulate or transfer the transfer skid 200 to and from the two bodies 10, 20. The lifting system 400 comprises a crane 410, e.g. knuckle boom telescopic crane, and a spreader frame attachment 420 removably coupled to a tip of the crane arm such as by a removable pin 422. The crane 410 may be mounted on a crane pedestal which may be mounted on the floating/fixed hydrocarbon facility 10. The spreader frame attachment 420 includes a powered rotator 424 or swivel which allows the spreader frame attachment 420 to rotate about the tip of the crane arm. The spreader frame attachment 420 also includes lifting devices, e.g. winches 426 for controlling guide wires 220 and winches for providing the lifting devices 430, 440 which support the transfer skid 200. The winches may be hydraulic-controlled with control panel and joysticks arranged on the parking platform 102 of the utility platform 100. The winches may also be equipped with a pressure relief valve and mechanical clutch for overloading protection. In addition, winch reels may have a mechanical guiding device to keep each wire in the groove when it is slack. In anticipation of relative heave motion during offloading operation, the guide wire winches 426 may provide a constant tension to the guide wires.

The lifting system 400 allows improved manipulation of the transfer skid 200. Particularly, the telescopic crane arm is extendable towards a desired destination to position the spreader frame attachment 420 thereon. Accordingly, the crane arm is capable of creating an additional adjustable horizontal and/or vertical extension to assist in installation and retrieval of the transfer skid 200 from a carrier vessel 20 (also referred to as "second body"). Since the spreader frame attachment 420 is rotatable relative to the tip of the crane arm, the spreader frame attachment 420 allows the transfer skid 200 to be angularly or rotationally adjusted in a horizontal plane. As a person skilled in the art would appreciate, it may not be possible to position a carrier vessel 20 in parallel with the floating/fixed hydrocarbon facility 10 due to environmental conditions, and therefore an angular displacement between the carrier vessel 10 and the floating/fixed hydrocarbon facility 10 is likely. Hence, the ability of the spreader frame attachment 420 to angularly or rotationally adjust the transfer skid 200 is particularly advantageous during installation when the transfer skid 200 is positioned on a carrier vessel 20 to align to a pipe deck 500 on the carrier vessel 20 and during retrieval of the transfer skid 200 after an offloading operation.

Figure 16:
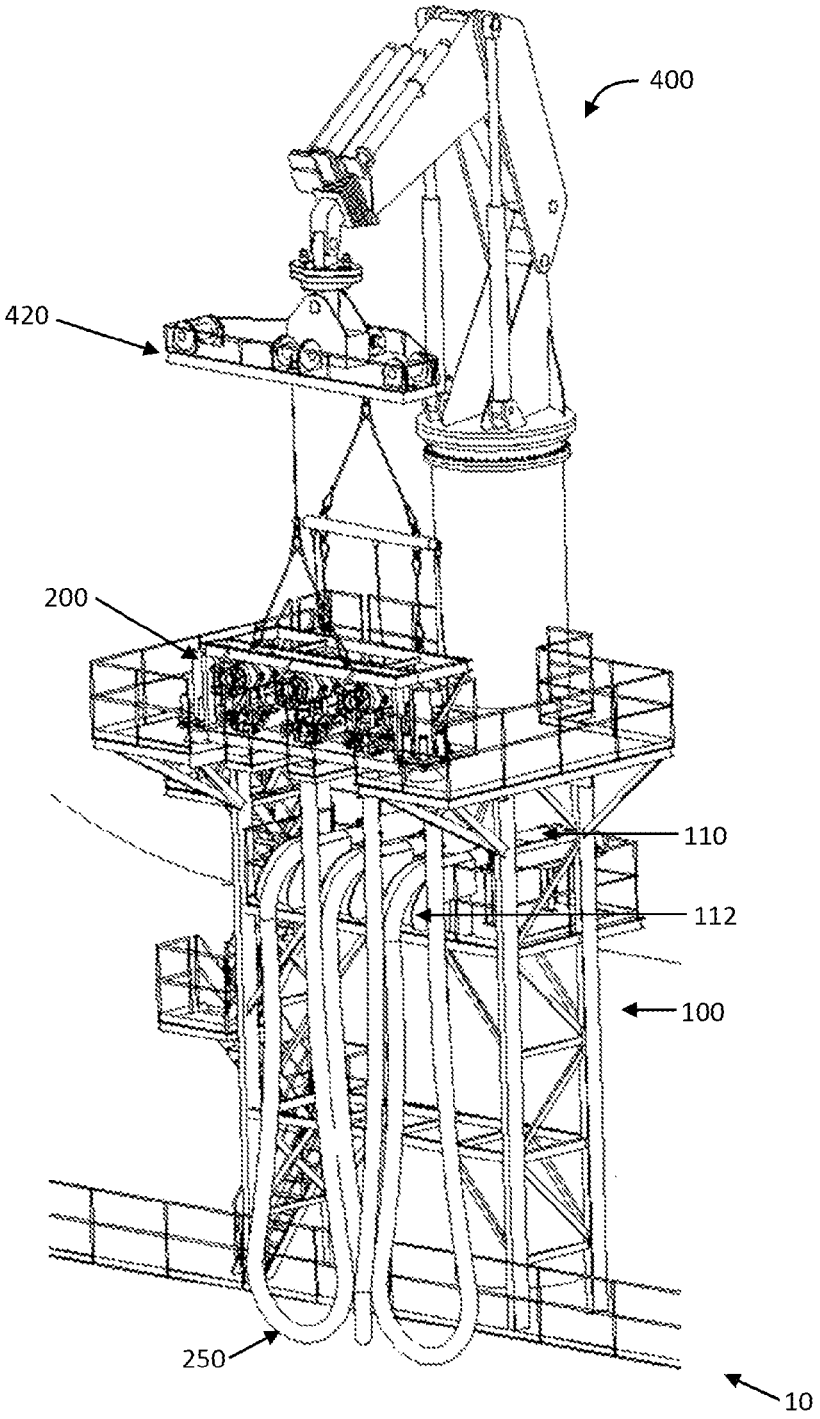
FIG. 16 illustrates the transfer skid returned to a parking position after an offloading operation.

Fixed hard pipe manifolds 110 (see FIG. 16) may be provided at the utility platform 100 to link the transfer hoses 250 to the process facilities on the vessel or terminal at which the utility platform 100 is located. Saddles 112 (see FIG. 16) may be provided on the utility platform 100 for maintaining minimum bending radius for resting transfer hoses 250. A monitoring system may be provided to detect changes in relative positions of the two bodies 10, 20 and thereby allowing a trigger of an emergency alarm. Particularly, position monitoring interrogators may be mounted on the utility platform 100 and transponders may be mounted on the transfer skid 200. The interrogators and transponders may be connected to a computer system which may determine the presence of an emergency situation based on readings taken from the interrogators and transponders, and initiate an emergency alarm if a change in relative positions of the two bodies 10, 20 breaches a predetermined threshold. Alternatively, an emergency alarm may be triggered by hardwires or cables which connect to the two bodies 10, 20. In the event the two bodies 10, 20 drift apart beyond a predetermined allowable working envelope during an offloading operation, the cables are pulled by the drifting away from the two bodies 10, 20 to trigger an emergency alarm. Hydraulic power units (HPU) may be provided on the floating/fixed hydrocarbon facility 10 to power various utilities e.g. crane, emergency release system, provided thereon.

FIGS. 3A to 3D illustrate various views of a transfer skid 200 according to one embodiment of the invention. The transfer skid 200 includes a skid frame 202 for supporting a plurality of rigid pipes 204. In the embodiment of FIGS. 3A to 3D, the skid frame 202 includes three pipes 204, where two pipes may be used for hydrocarbon fluid transfer and one pipe may be used for vapour return. It is to be appreciated that other configurations of the transfer skid 200 with other number of pipes 204 (e.g. two, three, or more) may be used with suitable modifications. Each pipe 204 may have an L-shape and is provided with insulation. At a first end of each pipe, a Quick Connect/Disconnect Coupler 212 (QCDC) is provided to connect to a manifold flange on a carrier vessel 20. While QCDCs 212 are presently illustrated and described, it is to be appreciated that other forms of couplers, whether a manual device e.g. bolted connection, or an automatic device, used to connect the transfer skid 200 to manifolds on the carrier vessel 20, may be used in certain other embodiments. At a second (distal) end of each pipe 204, an Emergency Release Coupling (ERC) 216 is provided to connect to a cryogenic transfer hose 250 which is flexible. In certain embodiments, the ERC 216 may have a dual-function, i.e. it can also function as a double block valve. Particularly, each of mating connectors 216*a*, 216*b* of the ERC 216 includes a valve which is capable of shutting or closing without detaching from each other; the valve is also capable of shutting or closing, and thereafter detach from each other. In certain other embodiments, separate double block valves may be provided in the pipes 204. A swivel 215 (optional) may be interposed or connected between the ERC 216 and the second end of each pipe 204 to allow rotational movement of the transfer skid 200 relative to the carrier vessel 20 after the transfer skid 200 is installed on the carrier vessel 20.

The pipes 204 may be rigidly attached to the skid frame 202 to prevent load unbalance and swaying movements due to wind. However, jack screws may be provided at each pipe 204 to allow independent adjustment of each pipe 204 relative to the skid frame 202 in one or more directions, e.g. x, y and z directions (see FIGS. 3C and 3D). Hence, each pipe 204 can be manipulated or repositioned independently of other pipes 204 to ensure improved mating of a pipe 204 with a manifold flange on a carrier vessel even if various flanges on the carrier vessel are unevenly located due to uneven deck or for other reasons. In certain embodiments, jack screws of the various pipes 204 may be connected or coupled together to allow simultaneous adjustment of two or more pipes 204. In certain other embodiments, other adjustment mechanisms, e.g. gears, chains, belts, may be used in place of jack screws.

The ERC 216 may be formed of a pair of mating parts or connectors (hereinafter ERC1 216*a* and ERC2 216*b* respectively) which are normally securely engaged to each other when the transfer skid 200 is disposed in a parked position and during offloading operation. The mating parts may be activated to disconnect from each other within a predetermined time during an emergency release operation. ERC1 216*a* connects to a transfer or flexible hose 250 which is to connect, directly or via other connectors or pipes 204, to a floating/fixed hydrocarbon facility 10. ERC2 216*b* is interposed or connected between ERC1 216*a* and the pipe 204, directly or indirectly through a swivel 215. A slack ERC hoist sling 222 attaches each ERC1 216*a* to a common spreader beam 210.

At two ends of the skid frame 202, shock absorbers or hydraulic dampeners 206 and guide funnels 208 may be provided. The shock absorbers 206 are constructed and arranged to dampen impact on the transfer skid 200 upon landing of the guide funnels 208 during installation of the transfer skid 200 on a carrier vessel. The guide funnels 208 are constructed and arranged to guide the transfer skid 200, in cooperation with guide wires 220, to a desired position during installation.

The skid frame 202 may have opposed sides which are supported by lifting devices or winches which may be capable of exerting independent control. Particularly, one side of the skid frame 202, which is proximate to the QC/DCs 212, may be supported by hoist wires 211*a* which are in turn supported by a first lifting device 430 (see FIGS. 3A and 3B). The opposed side of the skid frame 202, which is proximate to the ERCs 216, may be supported by hoist wires 211*b* which is supported by a spreader beam 210 which in turn is supported by a second lifting device 440 (see FIGS. 3A and 3B). When the transfer skid 200 is lifted, the skid frame 202 may potentially tilt due to varying loads of transfer hoses 250 resulting from varying heights as the transfer skid 200 is lifted or lowered. To prevent tilting of the skid frame 202, the lifting devices 430, 440 may independently adjust hoist wires 211*a*, 211*b* to position the skid frame 202 at a desired orientation.

Quick release connectors may be provided at the hoist wires 211*a*, 211*b* to allow disconnection of the transfer skid 200 from the spreader beam 210 and lifting devices.

As would be appreciated from the above, the functions of the transfer skid 200 include, but are not limited to, providing a connection interface for hydrocarbon fluid transfer between two bodies 10, 20 and allowing simultaneous transfer of multiple transfer hoses 250 with a single lift.

Figure 4:
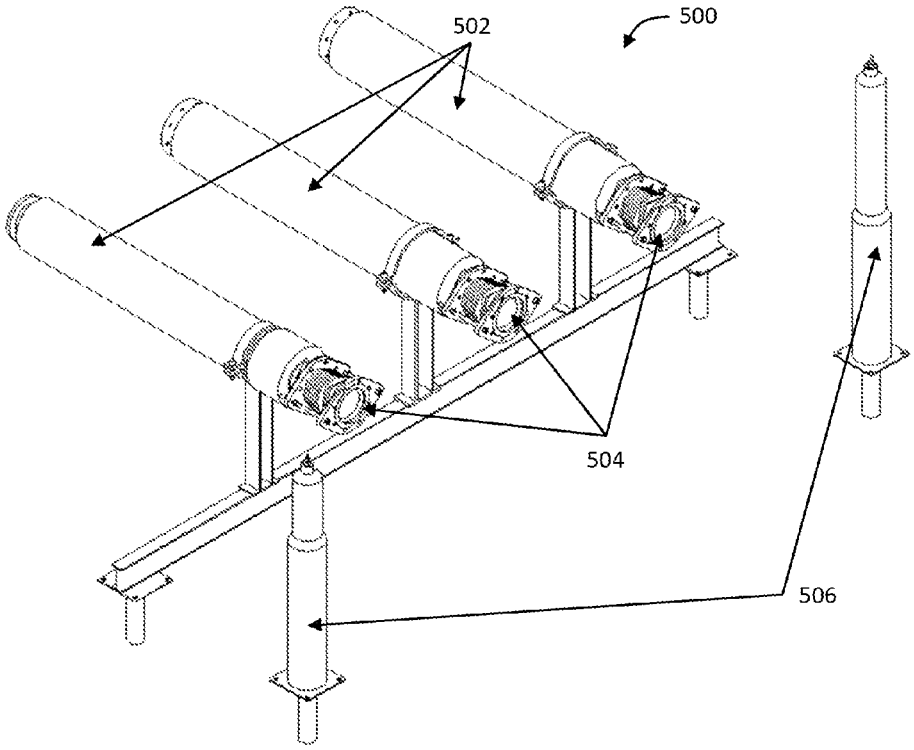
FIG. 4 illustrates a pipe deck.

FIG. 4 illustrates a pipe deck 500 or spool piece that can be removably connected to the manifolds of a carrier vessel 20. It is to be appreciated that manifolds are ducts for facilitating hydrocarbon fluid transfer to and from the carrier vessel 20. The manifolds may be located at a bow portion, a stern portion, a starboard side or a portside of a carrier vessel 20. As the pipe deck 500 contains pipe extensions 502 each terminating at a flange, connecting the pipe deck 500 to manifolds of the carrier vessel 20 effectively moves the position of the manifold flanges towards an outer edge of the carrier vessel 20. At each flange of the pipe extensions 502, a flexible expansion joint 504 is provided which is adapted to connect to a pipe 204 of the transfer skid 200. The flexible expansion joint 504 may be deflected in lateral, axial and angular directions relative to the pipe extension 502 to compensate for slight misalignment between the pipes 204 of the transfer skid 200 and flanges of the flexible expansion joint 504 prior to connection. Further, the pipe extensions 502 may be provided as straight-line pipes. Further, the pipe deck 500 may also be provided with guide posts 506 for receiving funnels 208 therein to guide the transfer skid 200 as it lands onto a carrier vessel 20.

Preparation for Offloading Operation & Offloading Operation

A sequence for installing a pipe deck 500 on a carrier vessel 20, connecting a transfer skid 200 to the carrier vessel 20 is described with reference to FIGS. 5 to 14.

Figure 5:
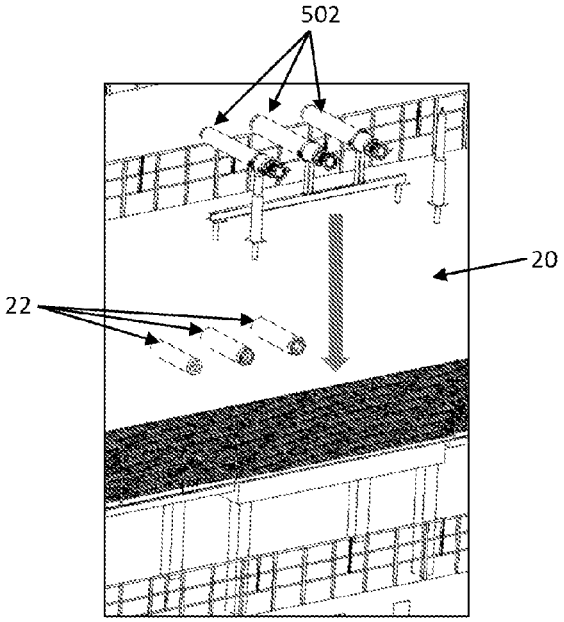
FIG. 5 illustrates a pipe deck being lowered onto a grating deck of a carrier vessel.
Figure 6:
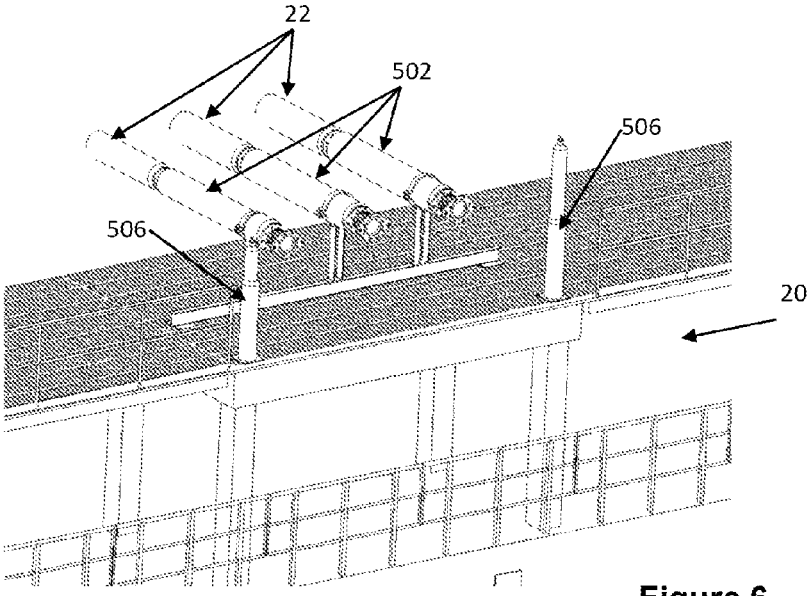
FIG. 6 illustrates pipe extensions of the pipe deck secured to the manifolds of the carrier vessel.

FIGS. 5 and 6 illustrate installation of a pipe deck 500 on a carrier vessel 20. In particular, FIG. 5 illustrates a pipe deck 500 being lowered onto a grating deck of a carrier vessel 20; FIG. 6 illustrates pipe extensions 502 of the pipe deck 500 secured to the manifolds 22 of the carrier vessel 20. Installation of a pipe deck 500 on a carrier vessel 20 may be carried out prior to each hydrocarbon fluid transfer operation. Alternatively, the pipe deck 500 may remain installed on the carrier vessel 20 in between hydrocarbon fluid transfer operations if, for example, the carrier vessel 20 is on a long term charter.

Figure 7:
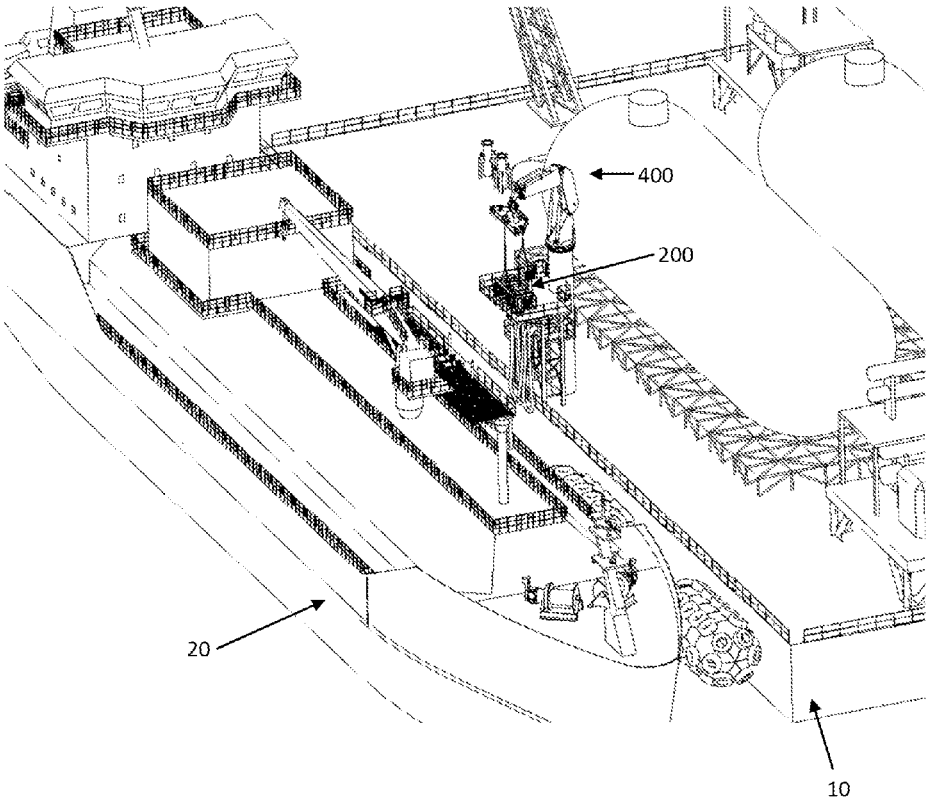
FIG. 7 illustrates a carrier vessel being moored in position in preparation for offloading operation.

FIGS. 7 to 14 illustrate various stages of connecting a transfer skid 200 to a carrier vessel 20 in preparation for offloading operation. FIG. 7 illustrates a carrier vessel 20 being moored to a floating/fixed hydrocarbon facility 10 in preparation for offloading operation. The carrier vessel 20 may be separated by a safe distance from the floating/fixed hydrocarbon facility 10 by floating pneumatic fenders. After the carrier vessel 20 is moored in position and depending on operator requirement and preference, mooring load monitoring may be set up, weather and environment conditions may be monitored to ensure that an offloading operation may commence safely.

Figure 8:
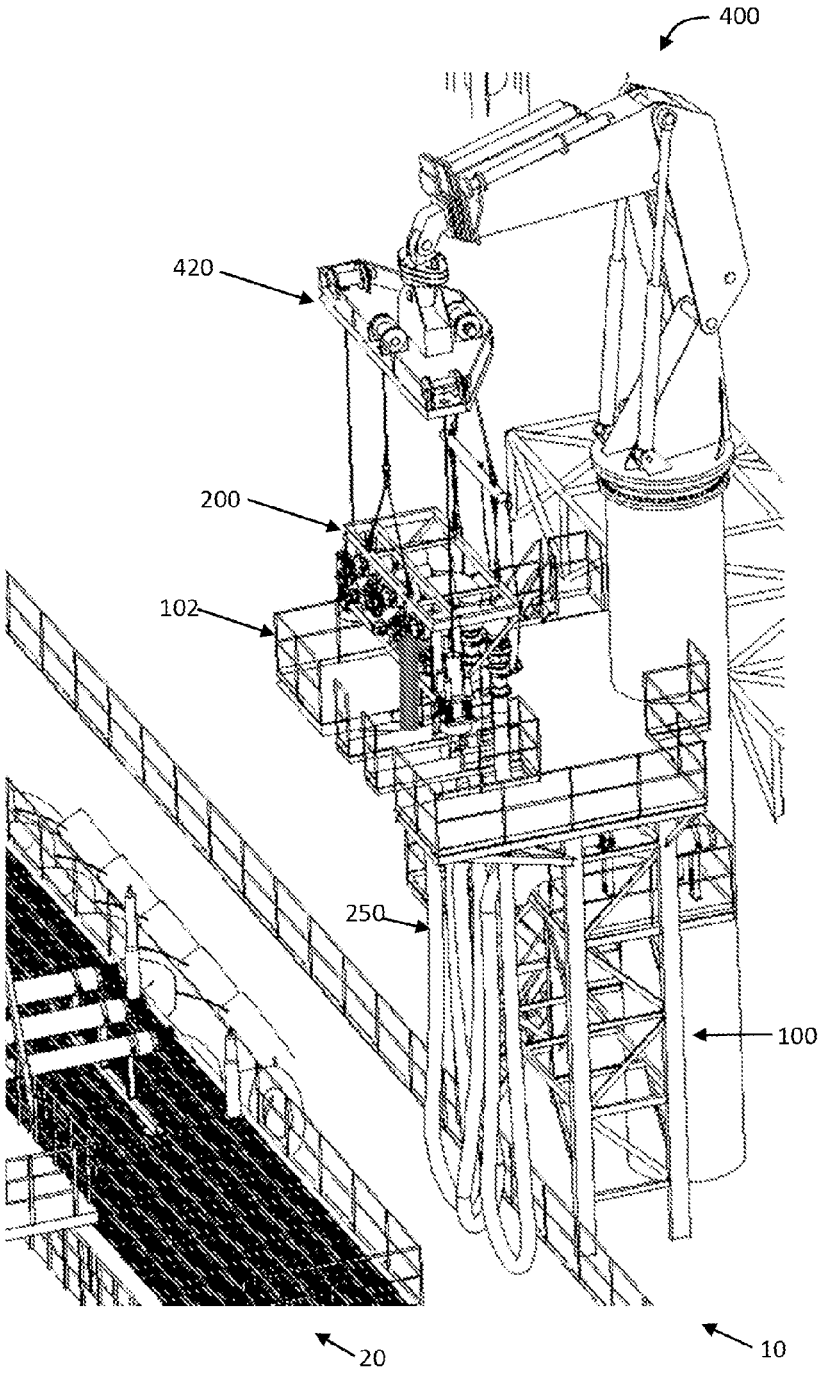
FIG. 8 illustrates a transfer skid being lifted from a parking position.
Figure 9:
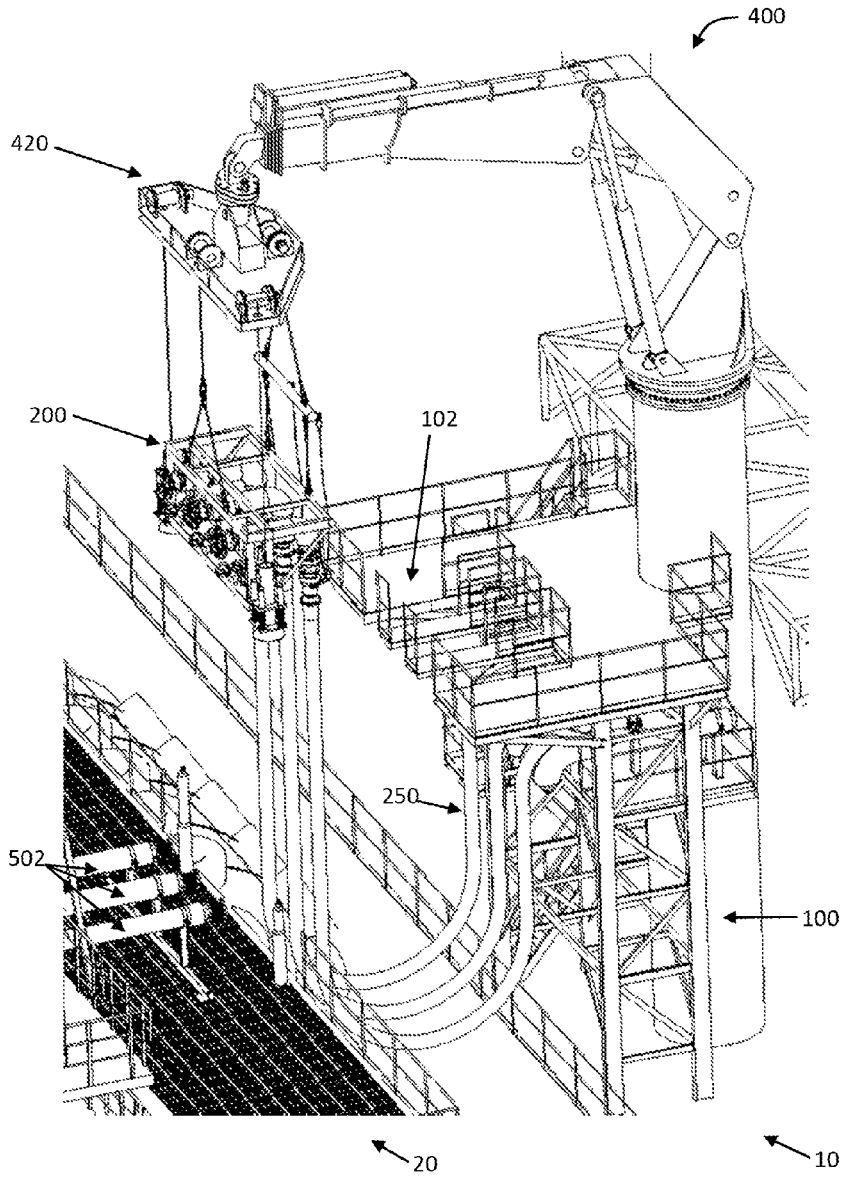
FIG. 9 illustrates the transfer skid being lifted over the pipe deck which is disposed on the carrier vessel.

FIG. 8 illustrates a transfer skid 200 being lifted from a parking position at the floating/fixed hydrocarbon facility 10. At the parking position, the transfer skid 200 is supported on a parking platform 102. The transfer skid 200 may be hoisted from the parking platform 102 by a lifting system 400, particularly the lifting devices 430, 440 provided on the spreader frame attachment 420 of the lifting system 400. A guiding device may be activated, e.g. guide wires 220 may reeled out from the spreader frame attachment 420 towards the parking platform 102 to be attached to each guide funnel 208 of the transfer skid 200 via a catch ball (see FIG. 8). After the guide wires 220 are secured to the transfer skid 200, the lifting system 400 may move the hoisted transfer skid 200, together with the transfer hoses 250, towards the carrier vessel 20. Particularly, the crane arm of the lifting system 400 is extended towards the carrier vessel 20 (see FIG. 9). The hoisted transfer skid 200 is then positioned approximately directly above the pipe deck 500 on the carrier vessel 20.

Figure 10:
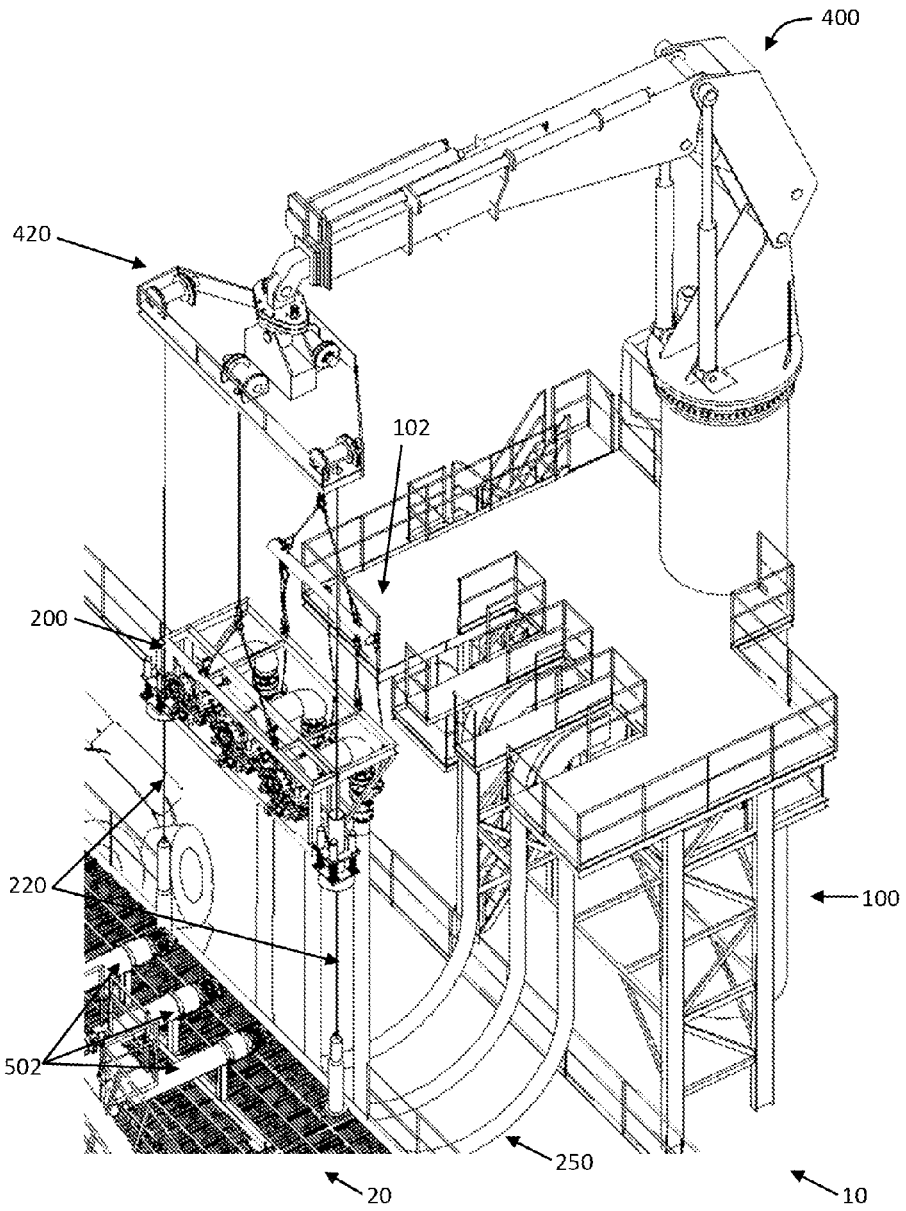
FIG. 10 illustrates guide wires attached to guide posts of the pipe deck.
Figure 11:
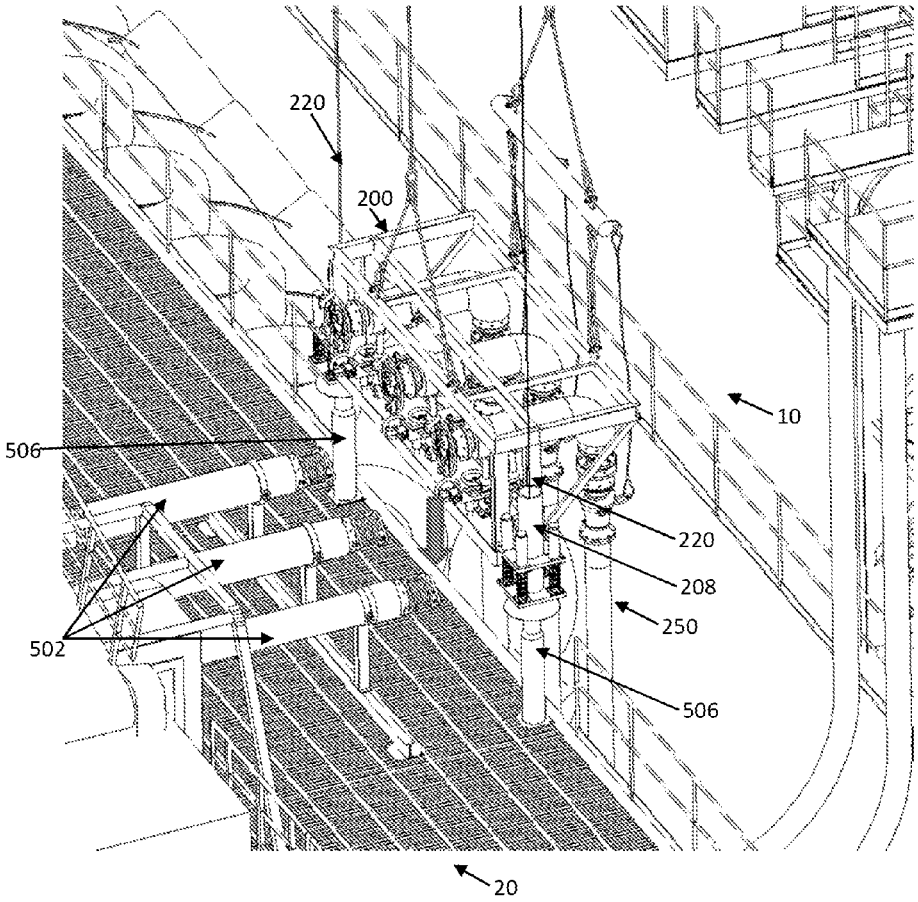
FIG. 11 illustrates the transfer skid being lowered onto the pipe deck.

Once the transfer skid 200 is positioned approximately over the pipe deck 500, the guide wires 220 may be lowered towards the pipe deck 500 on the carrier vessel 20 (see FIG. 10). Crew members on the carrier vessel 20 may grab the catch ball at the tips of the guide wires 220 and attach each guide wire 220 to each guide post 506 of the pipe deck 500. As the sea state may create a relative motion between the carrier vessel 20 and the floating/fixed hydrocarbon facility 10; the guide wires 220 will act as a guide to direct the funnel 208 of the transfer skid 200 towards the guide post 506 of the pipe deck 500. Once the guide wires 220 are secured to the guide post 506 of the pipe deck 500, the guide winches 426 maintain a constant tension in the guide wires 220. The transfer skid 200 may then be lowered towards the pipe deck 500 where the guide posts 506 will be inserted into the respective funnels 208, thereby guiding the transfer skid 200 to land onto the pipe deck 500 (see FIG. 11).

Figure 12:
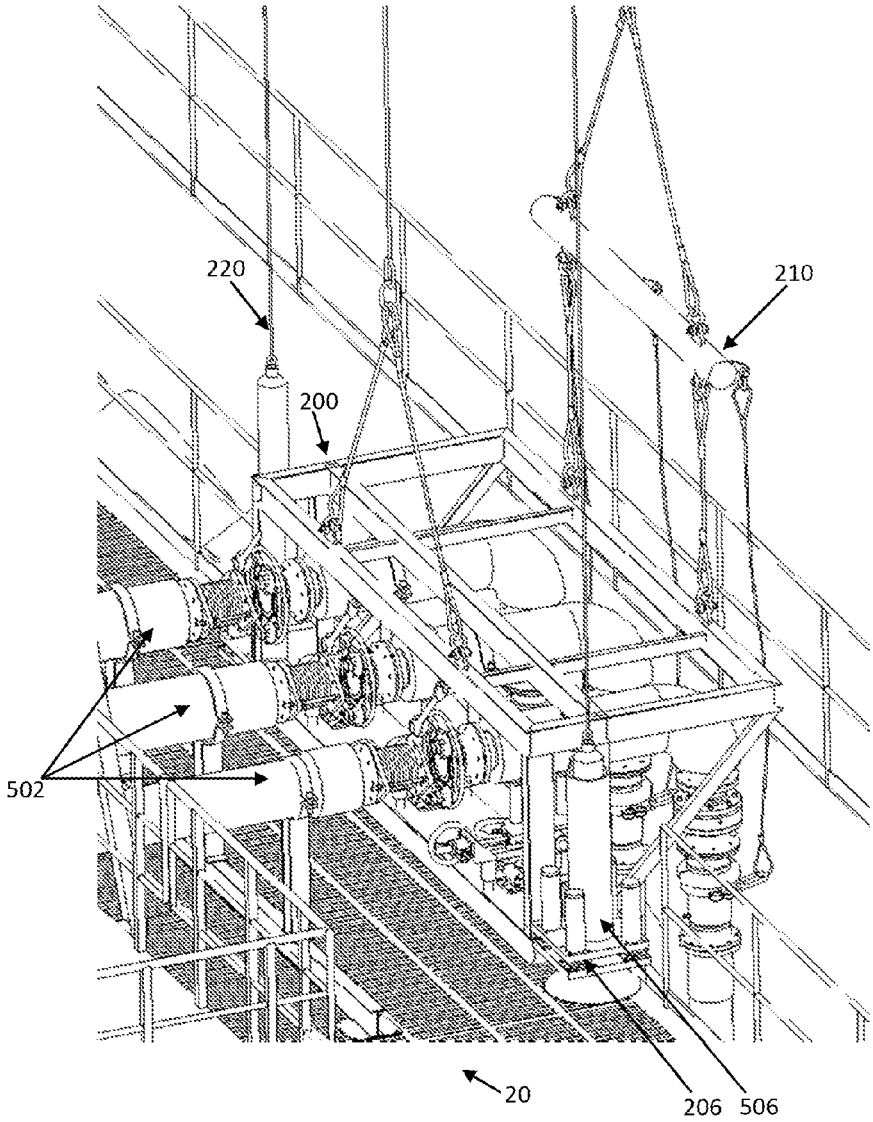
FIG. 12 illustrates the transfer skid being landed onto the pipe deck.

During landing, funnels 208 of the transfer skid 200 may collide with the deck of the carrier vessel 20 (see FIG. 12). The collision impact from landing of the transfer skid 200 may be significantly reduced by the shock absorbers 206 disposed at both sides of the funnels 208 of the transfer skid 200. This would prevent both the transfer skid 200 and pipe deck 500 from being damaged by impact shock during landing due to sudden relative heave motion between the carrier vessel 20 and the floating/fixed hydrocarbon facility 10. The shock absorbers 206 also reduce impact on the transfer skid 200 when the guide posts 506 are directed into the funnels 208.

Figure 13:
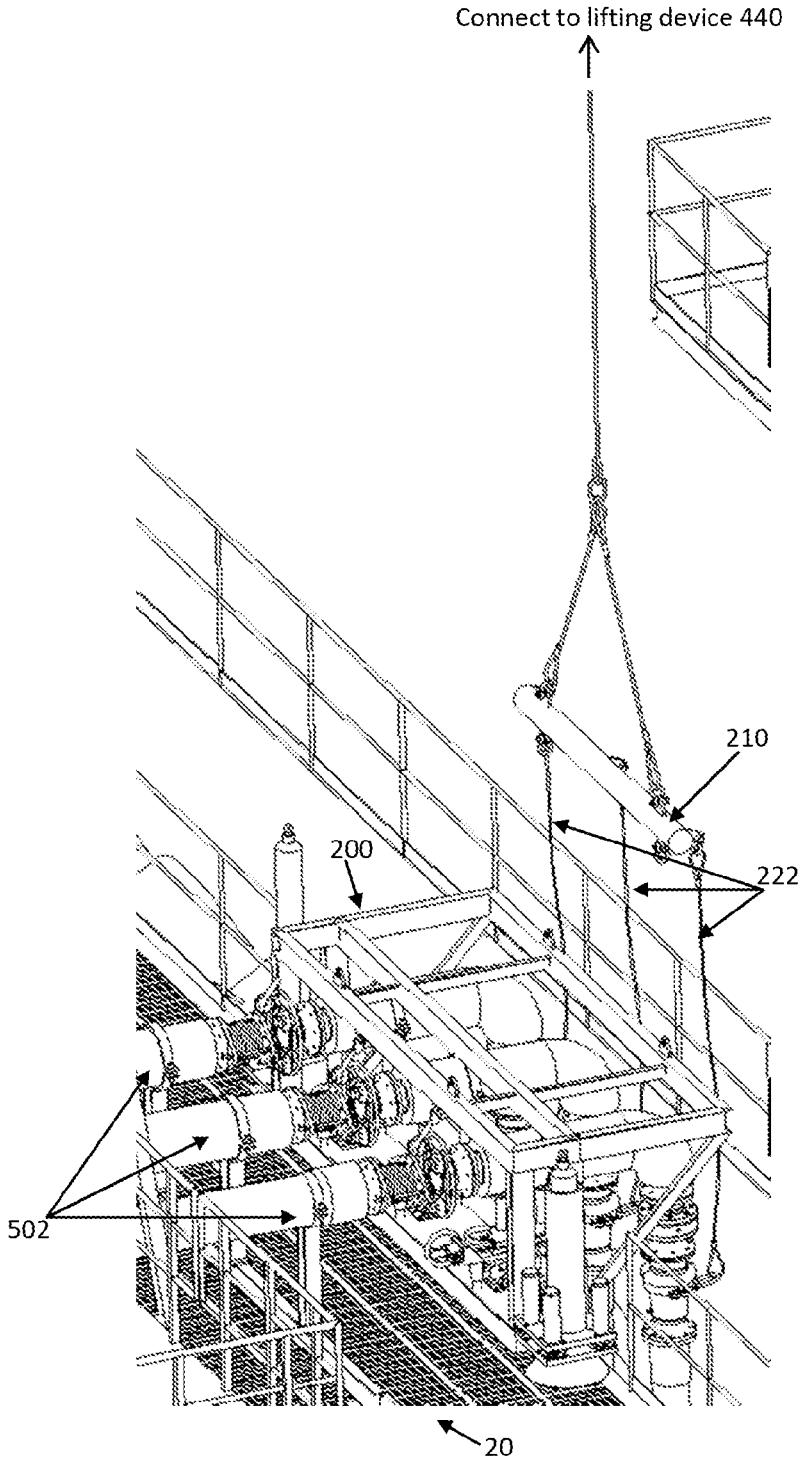
FIG. 13 illustrates all hoist wires disconnected and the guide wires disconnected from the lifting system.
Figure 14:
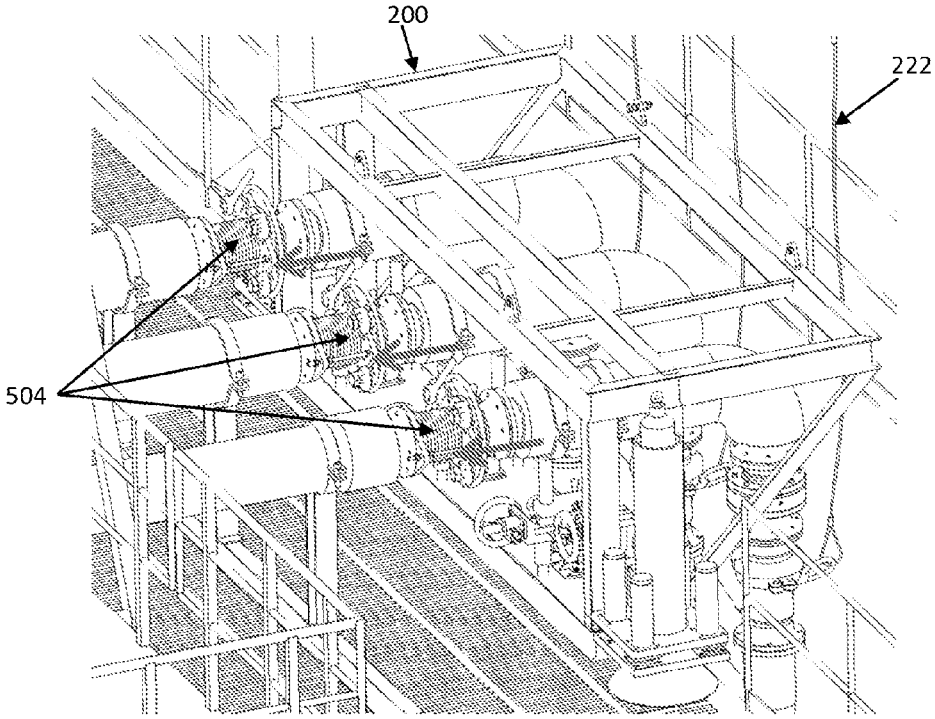
FIG. 14 illustrates adjustments to the alignment of the QCDCs of the transfer skid by jack screw mechanisms for engaging the QCDCs with the flanges of the flexible expansion joints.

At this stage, the hoist wires 211*a*, 211*b* supporting the transfer skid 200 may be disconnected from the lifting system 400 (see FIG. 13). Particularly, hoist wires 211*a* are disconnected from the first lifting device 430 while hoist wires 211*b* are disconnected from the spreader beam 210. However, the ERCs 216 remain connected to the spreader beam 210 by ERC hoist sling 222, and the spreader beam 210 remains connected to and supported by a second lifting device 440 of the lifting system 400.

Although the transfer skid 200 is landed onto the carrier vessel 20, there may exist gaps between the QCDCs 212 of the transfer skid 200 and the flanges of the flexible expansion joint 504. Adjustments to the alignment of the QCDCs 212 to engage with the flanges of the flexible expansion joints 504 may be performed by jack screw mechanisms provided in the transfer skid 200. Particularly, jack screw mechanism of each pipe 204 of the transfer skid 200 may be controlled to move the pipe 204 in vertical, horizontal and/or transverse directions. Thereafter, fine adjustments to the alignment of the QCDCs 212 to engage with the flanges of the flexible expansion joints 504 may be compensated by the flexible expansion joints 504 provided at the pipe extensions (see FIG. 14). After the QCDCs 212 are aligned with the connecting flanges, cam locks of the QCDCs 212 may be activated to lock or secure the QCDCs 212 to the flanges of the flexible expansion joints 504.

At this stage, the transfer skid 200 is installed at the carrier vessel 20 in preparation for an offloading operation. The QCDCs 212 are disposed inboard the carrier vessel 20, e.g. above the main deck of the carrier vessel 20, while the ERCs 216 are disposed outboard of the carrier vessel 20, e.g. exterior of the carrier vessel 20 and over the sea. This is possible as each QCDC 212 is spaced apart from an ERC 216 by a pipe 204 interposed or connected therebetween.

Before commencing offloading operation, the lifting system 400 may retract and the ERC hoist slings 222 connected to the spreader beam 210 may be allowed to slack. Other checks and procedures may take place as required. Offloading operation may then take place in which hydrocarbon fluid, e.g. liquefied natural gas (LNG), may be transferred from the carrier vessel 20 to the floating/fixed hydrocarbon facility 10 by way of transfer pumps. Hydrocarbon fluid is transferred from the carrier vessel 20 to the floating/fixed hydrocarbon facility 10, or vice versa, via the fluidly connected transfer hoses 250, pipes 204 of the transfer skid 200 and pipe extensions 502 installed on the carrier vessel 20. In one embodiment, two transfer hoses 250 are configured for hydrocarbon fluid transfer while the remaining hose 250 is configured for vapour return. In certain embodiments, vapour return may not be required. During offloading, transfer hoses 250 may be disposed outboard of the carrier vessel 20 and floating/fixed hydrocarbon facility 10 and hung in a catenary form. This way, less stress will be induced in the transfer hoses 250.

After the offloading operation is completed, various checks and procedures may take place to ensure that the hydrocarbon fluid transfer is ceased and it is safe to disconnect the transfer skid 200. The lifting system 400 may be deployed to connect to the transfer skid 200 in preparation to return the transfer skid 200 to the floating/fixed hydrocarbon facility 10 after the transfer skid 200 is disconnected from the carrier vessel 20. In one embodiment where the ERCs 216 has a dual function of a double block valve, after transfer pumps are stopped, the valves in the ERCs 216 may be closed and hydrocarbon fluid in the pipes 204 of the transfer skid 200 may be drained and purged towards the carrier vessel 20. After purging, the transfer skid 200 may be disconnected from the pipe deck 500 by unlocking the QCDCs 212 of the transfer skid 200. The transfer skid 200, supported by the lifting system 400, may be lifted away from the carrier vessel 20 and the carrier vessel 20 may then move off as and when required without waiting for hydrocarbon fluid remaining in the transfer hoses 250 to boil off and to be purged as required in conventional systems. Embodiments of the invention thus allow faster disconnection of the transfer skid 200 after an offloading operation is completed, and without waiting for hydrocarbon fluid in the transfer hoses 250 to boil off and to be purged before disconnecting the transfer skid 200 from the carrier vessel 20. In certain embodiments, the separate double block valves may be provided in the pipes 204 and may also be similarly utilized as described above.

Figure 15:
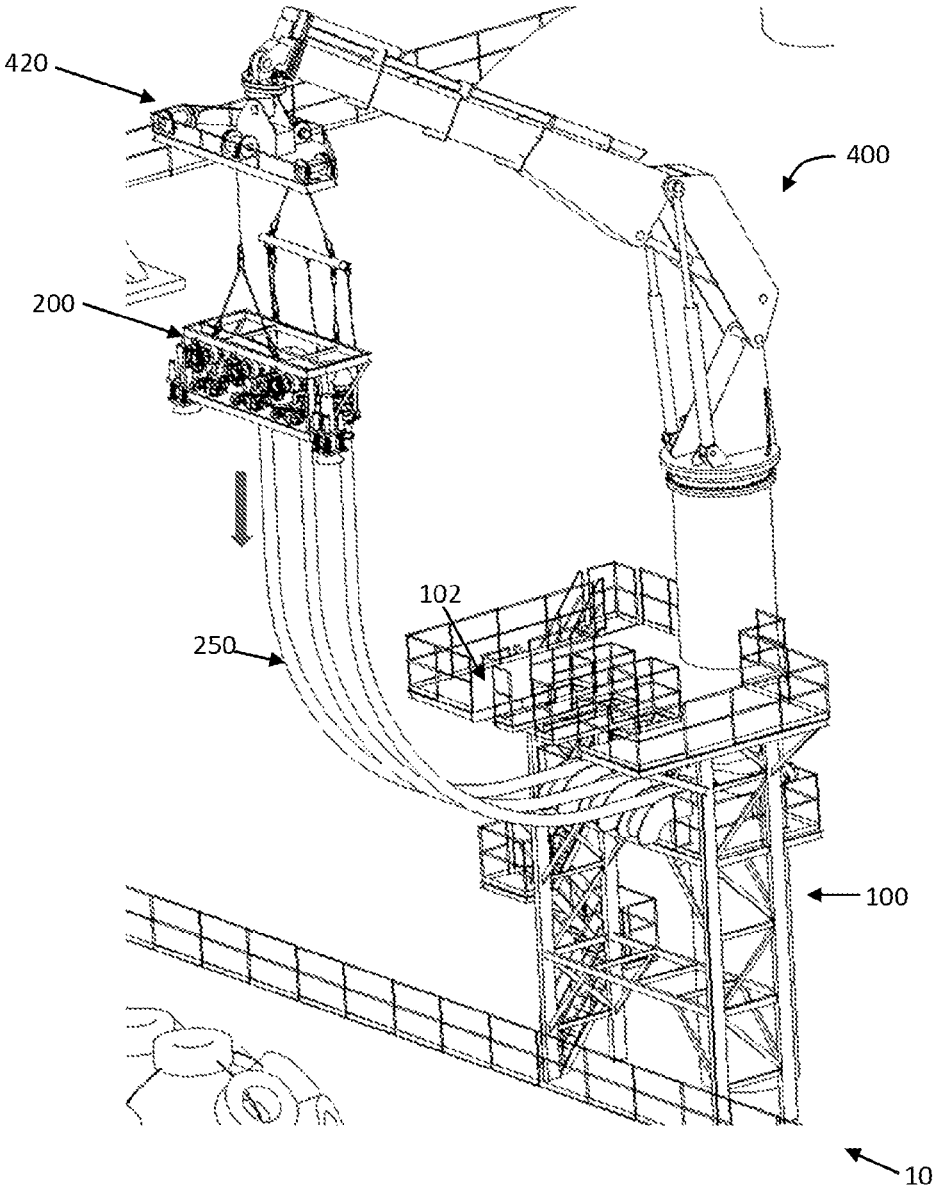
FIG. 15 illustrates draining of hydrocarbon fluid from the transfer hoses after an offloading operation.

The transfer skid 200, supported by the lifting system 400, is lifted to allow hydrocarbon fluid in the transfer hoses 250 drain by gravity towards the floating/fixed hydrocarbon facility 10 (see FIG. 15). Subsequently, when the transfer skid 200 is returned to the parking position, any hydrocarbon fluid remaining in the transfer hoses 250 will be purged by nitrogen (see FIG. 16). Various other checks and processes may take place to ensure all valves are sufficiently safe to be opened.

Emergency Situation and Emergency Release Operation

During the offloading operation, an emergency situation may occur that requires the transfer hoses 250 to separate or disconnect from the carrier vessel 20 safely and quickly. Examples of an emergency situation include, but are not limited to, extreme weather and environmental conditions causing carrier vessel 20 to drift away from the floating/fixed hydrocarbon facility 10, failure of mooring lines resulting in undesirable repositioning of the carrier vessel 20, and fire breakout.

Once the operating conditions are ascertained to have exceeded certain safe operating threshold, an Emergency Shut Down situation may be triggered in which transfer pumps are stopped and an Emergency Release System may be subsequently triggered to disconnect the transfer hoses 250 from the transfer skid 200 installed at the carrier vessel 20. Particularly, the ERCs 216 are activated to detach the parts 216*a*, 216*b* or connectors forming the ERC 216 (see FIG. 17). Once disconnected, the detached part 216*a* of each ERC 216 will fall away from the transfer skid 200 due to gravity force. As the ERC 216 is arranged outboard of the carrier vessel 20, the detached part 216*a* of each ERC 216 is allowed to free-fall together with the corresponding transfer hose 250 attached thereto.

Figure 17:
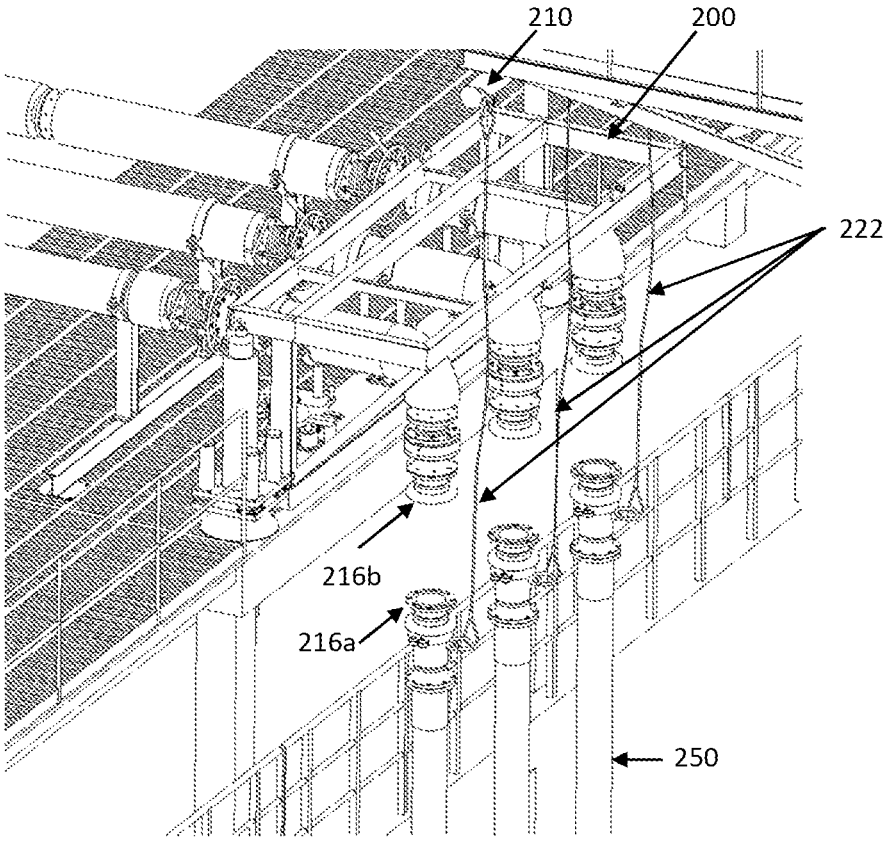
FIG. 17 illustrates disconnected halves of the ERC.
Figure 18:
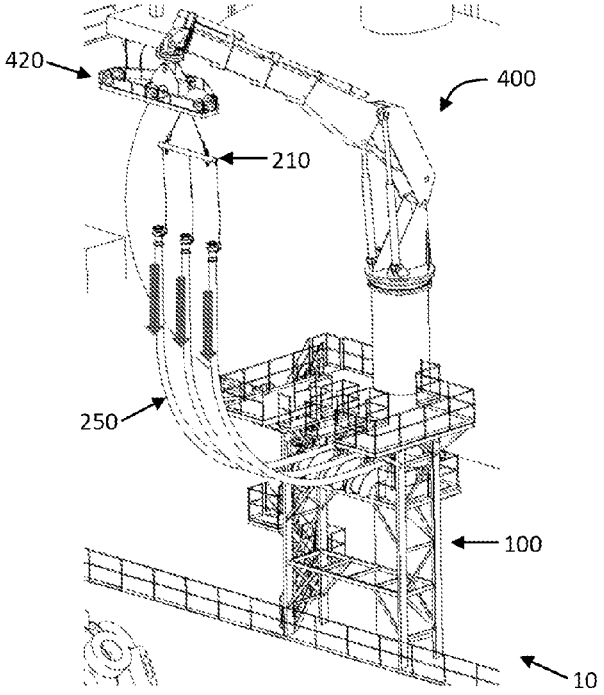
FIG. 18 illustrates draining of hydrocarbon fluid from the transfer hoses after an emergency release operation.
Figure 19:
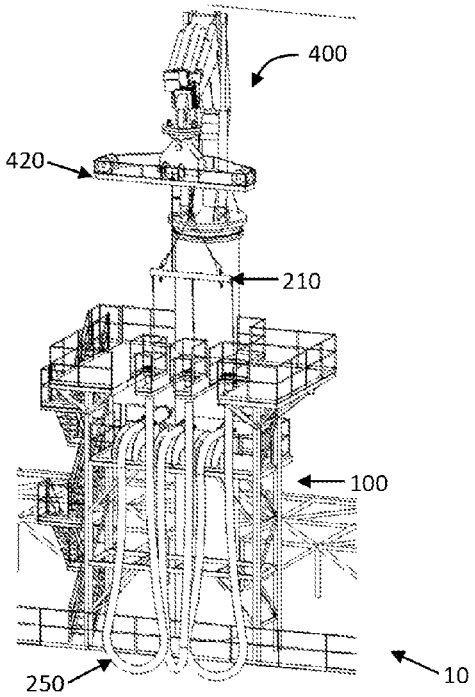
FIG. 19 illustrates transfer hoses returned to the floating/fixed hydrocarbon facility after an emergency release operation.

However, the fall of the detached part 216*a* of the ERC 216 may be limited by the second lifting device 440 which supports the detached part 216*a* of the ERC. Particularly, as illustrated in FIG. 17, the detached part 216*a* of each ERC 216 is separately supported by an ERC hoist sling 222, which is attached to the spreader beam 210 which in turn remains supported by the second lifting device 440 provided by the lifting system 400 disposed on the floating/fixed hydrocarbon facility 10. Therefore, the fall of the detached part 216*a* of each ERC 216 is limited by the length of slack in the ERC hoist sling 222. Once the slack ERC hoist slings 222 become taut or fully extended, the detached part 216*a* of each ERC 216 is prevented from falling further. Draining and purging of the transfer hoses 250 may take place as a safety measure (see FIG. 18). Subsequently, the detached part 216*a* of the ERCs 216 and transfer hoses 250 are then returned to the floating/fixed hydrocarbon facility 10 by the lifting devices 430, 440 (see FIG. 19).

During the emergency release of the ERCs 216, the transfer skid 200, including pipes 204, QCDCs 212 and the other part 216*b* of the ERCs 216 which is attached to the QCDCs 212, will remain installed at the carrier vessel 20 until the emergency situation is brought under control or is resolved. Subsequently, a separate operation may be initiated to uninstall the transfer skid 200 from the carrier vessel 20 and move or return the transfer skid 200 to the floating/fixed hydrocarbon facility 10. Suitable procedures may take place to re-assemble the detached ERC parts 216*a*, 216*b* to prepare the transfer skid 200 for the next offloading operation.

In the above-described offloading operation, emergency release operation and return of the detached ERCs 216 to the parked position, the transfer hoses 250 may be allowed to hang naturally in a catenary form.

Embodiments of the invention achieve various advantages such as but not limited to the following:

(1) If an emergency release is required during an offloading operation, the ERCs are disconnected thereby resulting in one halves of the ERCs and the corresponding transfer hoses detach from the transfer skid. The detached connector of each ERC and corresponding transfer hose may free fall up to a predetermined distance but are nonetheless supported by a spreader beam and lifting system. The detached connector of each ERC may be moved or returned to the utility platform or parked position using the lifting system. Accordingly, when an emergency condition occurs, the carrier vessel may move away to safety upon detaching of the ERC. This results in a faster and safer emergency release operation.

(2) During an offloading operation, the ERCs would be disposed outboard. If emergency release is required, the disconnected ERCs would free fall towards the sea and therefore would not result in hydrocarbon spill on the carrier vessel or collision with the carrier vessel.

(3) Although the transfer skid allow simultaneous transport of the multiple pipes and transfer hoses from a floating/fixed hydrocarbon facility to a carrier vessel, each pipe of the transfer skid may be independently positioned and connected to the flanges of flexible expansion joints on the carrier vessel. This improves mating connection even if there is misalignment which may be due various reasons, e.g. a deck of the carrier vessel supporting the pipe deck is uneven or tilted.

(4) The transfer skid supports multiple transfer devices so that transport of the transfer hoses together with the QCDCs and ERCs between two bodies is simultaneous and therefore efficient.

Other embodiments will be apparent to those skilled in the art from consideration of the specification and practice of the invention. Furthermore, certain terminology has been used for the purposes of descriptive clarity, and not to limit the disclosed embodiments of the invention. The embodiments and features described above should be considered exemplary, with the invention being defined by the appended claims.

The invention claimed is:

1. An offloading system for facilitating hydrocarbon fluid transfer between two bodies, comprising:

a transfer skid which is movable from a first body to a second body to be installed thereupon, the transfer skid comprising:

a skid frame;

a plurality of pipes which are rigidly attached to the skid frame;

a plurality of jack screw mechanisms for independently adjusting the pipes relative to the skid frame, each of the pipes having a first end and a second distal end;

a coupler provided at the first end of the each of the pipes to connect to the second body after installing the transfer skid on the second body;

an emergency release coupling provided at the second end of the each of the pipes; a transfer hose connected between the emergency release coupling and the first body; and a lifting system provided on the first body, the lifting system comprising:

an extendable lifting arm;

a spreader frame attachment which includes at least a first and a second lifting device to support the transfer skid, wherein the spreader frame attachment is rotatably coupled to the extendable lifting arm to allow angular adjustment of the transfer skid in a horizontal plane, wherein the first lifting device is adapted to support one side of the skid frame which is proximate to the coupler, and the second lifting device is adapted to support an opposed side of the skid frames which is proximate to the emergency release coupling, and wherein the first lifting device and the second lifting device are adapted to independently adjust the skid frame to prevent tilting of the skid frame.

2. The offloading system of claim 1, wherein the coupler is adapted to connect to a pipe extension installed on the second body, wherein the pipe extension includes a flexible expansion joint which is deflectable in an axial direction, a lateral direction and an angular direction to align with the coupler.

3. The offloading system of claim 1, wherein the spreader frame attachment is further removably coupled to the extendable lifting arm.

4. The offloading system of claim 1, wherein the coupler and the emergency release coupling are arranged spaced apart so that after installing the transfer skid onto the second body, the coupler is disposed inboard the second body while the emergency release coupling is disposed outboard of the second body.

5. The offloading system of claim 4, wherein the emergency release coupling disconnects the transfer hose from the transfer skid which is installed at the second body by way of detaching a part of the emergency release coupling, and allowing the detached part of the emergency release coupling, together with the transfer hose connected thereto, to fall away from the transfer skid due to gravity force.

6. The offloading system of claim 5, wherein the detached part of the emergency release coupling is supported by the lifting system to limit the fall of the detached part of the emergency release coupling.

7. The offloading system of claim 6, wherein the transfer hose maintains a catenary form during the fall of the detached part of the emergency release coupling by way of an attachment of the detached part of the emergency release coupling to a spreader beam which is supported by the lifting system.

8. A method of transferring hydrocarbon fluid, the method comprising:

moving a transfer skid from a first body to a second body using a lifting system provided on the first body, wherein the transfer skid comprises:

a skid frame;

a plurality of pipes which are rigidly attached to the skid frame;

a plurality of jack screw mechanisms for independently adjusting the pipes relative to the skid frame, each of the pipes having a first end and a second distal end;

a coupler provided at the first end of the each of the pipes to connect to the second body after installing the transfer skid on the second body;

an emergency release coupling provided at the second end of the each of the pipes;

a transfer hose connected between the emergency release coupling and the first body; and wherein the lifting system comprises:

an extendable lifting arm;

a spreader frame attachment which includes at least a first and a second lifting device to support the transfer skid, wherein the spreader frame attachment is rotatably coupled to the extendable lifting arm to allow angular adjustment of the transfer skid in a horizontal plane, wherein moving a transfer skid from the first body to the second body includes having the first lifting device and the second lifting device independently adjust the skid frame to prevent tilting of the skid frame, wherein the first lifting device is adapted to support one side of the skid frame which is proximate to the coupler, and the second lifting device is adapted to support an opposed side of the skid frame which is proximate to the emergency release coupling;

adjusting the pipes independently of one another to position the pipes on the second body;

connecting the transfer skid to the second body to allow fluid communication between the first and the second body; and transferring hydrocarbon fluid from the first body to the second body or vice versa.

9. The method of claim 8, wherein connecting the transfer skid to the second body includes connecting the coupler to a pipe extension installed on the second body, wherein the pipe extension includes a flexible expansion joint which is deflectable in an axial direction, a lateral direction and an angular direction to align with the coupler.

10. The method of claim 8, wherein the coupler and the emergency release coupling are arranged spaced apart, the method further comprising:

after installing of the transfer skid, having the couplet disposed inboard the second body and the emergency release coupling disposed out the second body.

11. The method of claim 10, further comprising:

disconnecting the transfer hose from the transfer skid which is installed at the second body by detaching a part of the emergency release coupling; and allowing the detached part of the emergency release coupling, together with the transfer hose connected thereto, to fall away it the transfer skid due to gravity force.

12. The method of claim 11, further comprising:

limiting the fall of the detached part of the emergency release coupling by having the detached part of the emergency release coupling supported by the lifting system.

13. The method of claim 12, further comprising:

having the transfer hose maintain a catenary form during the fall of the detached part of the emergency release coupling by way of an attachment of the detached part of the emergency release coupling to a spreader beam which is supported by the lifting system.

14. An offloading system for facilitating hydrocarbon fluid transfer between two bodies, comprising:

a transfer skid which is movable from a first body to a second body to be installed thereupon, the transfer skid comprising:

a skid frame;

a plurality of pipes which are rigidly attached to the skid frame;

a plurality of jack screw mechanisms for independently adjusting the pipes relative to the skid frame, each of the pipes having a first end and a second distal end;

a coupler provided at the first end of the each of the pipes to connect to the second body after installing the transfer skid on the second body;

an emergency release coupling provided at the second end of the each of the pipes;

a transfer hose connected between the emergency release coupling and the first body; and a lifting system provided on the first body, the lifting system comprising:

an extendable lifting arm;

a spreader frame attachment which includes at least a first and a second lifting device to support the transfer skid, wherein the spreader frame attachment is rotatably coupled to the extendable lifting arm to allow angular adjustment of the transfer skid in a horizontal plane, wherein the coupler and the emergency release coupling are arranged spaced apart so that after installing the transfer skid onto the second body, the coupler is disposed inboard the second body while the emergency release coupling is disposed outboard of the second body, wherein the emergency release coupling disconnects the transfer hose from the transfer skid which is installed at the second body by way of detaching a part of the emergency release coupling, and allowing the detached part of the emergency release coupling, together with the transfer hose connected thereto, to fall away from the transfer skid due to gravity force, wherein the detached part of the emergency release coupling is supported by the lifting system to limit the fall of the detached part of the emergency release coupling, and wherein the transfer hose maintains a catenary form during the fall of the detached part of the emergency release coupling by way of an attachment of the detached part of the emergency release coupling to a spreader beam which is supported by the lifting system.

15. A method of transferring hydrocarbon fluid, the method comprising:

moving a transfer skid from a first body to a second body using a lifting system provided on the first body, wherein the transfer skid comprises:

a skid frame;

a plurality of pipes which are rigidly attached to the skid frame;

a plurality of jack screw mechanisms for independently adjusting the pipes relative to the skid frame, each of the pipes having a first end and a second distal end;

a coupler provided at the first end of the each of the pipes to connect to the second body after installing the transfer skid on the second body;

an emergency release coupling provided at the second end of the each of the pipes and spaced apart from the coupler;

a transfer hose connected between the emergency release coupling and the first body; and wherein the lifting system comprises:

an extendable lifting arm;

a spreader frame attachment which includes at least a first and a second lifting device to support the transfer skid, wherein the spreader frame attachment is rotatably coupled to the extendable lifting arm to allow angular adjustment of the transfer skid in a horizontal plane, wherein moving the transfer skid from the first body to the second body includes having the first lifting device and the second lifting device independently adjust the skid frame to prevent tilting of the skid frame;

after installing of the transfer skid, having the coupler disposed inboard the second body and the emergency release coupling disposed outboard of the second body;

disconnecting the transfer hose from the transfer skid which is installed at the second body by detaching a part of the emergency release coupling;

allowing the detached part of the emergency release coupling, together with the transfer hose connected thereto, to fall away from the transfer skid due to gravity force;

limiting the fall of the detached part of the emergency release coupling by having the detached part of the emergency release coupling supported by the lifting system; and having the transfer hose maintain a catenary form during the fall of the detached part of the emergency release coupling by way of an attachment of the detached part of the emergency release coupling to a spreader beam which is supported by the lifting system.

* * * * *